US007670190B2

(12) United States Patent
Shi et al.

(10) Patent No.: US 7,670,190 B2
(45) Date of Patent: Mar. 2, 2010

(54) ROTATABLE ELECTRICAL INTERCONNECTION DEVICE

(75) Inventors: Hou-Yu Shi, Kunshan (CN); David Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/499,673

(22) Filed: Jul. 8, 2009

(65) Prior Publication Data

US 2010/0009574 A1 Jan. 14, 2010

(30) Foreign Application Priority Data

Jul. 8, 2008 (CN) ..... 2008 2 0301476.9
Aug. 4, 2008 (CN) ..... 2008 1 0303329.X

(51) Int. Cl.
*H01R 33/92* (2006.01)

(52) U.S. Cl. ..... 439/640

(58) Field of Classification Search ..... 439/640, 439/446, 165, 31
See application file for complete search history.

(56) References Cited

U.S. PATENT DOCUMENTS 5,138,678 A * 8/1992 Briggs et al. ..... 385/86
6,338,645 B1 * 1/2002 Tan et al. ..... 439/446
6,475,021 B1 * 11/2002 Tan et al. ..... 439/446
6,699,075 B1 * 3/2004 Ko ..... 439/607.48
7,004,783 B2 * 2/2006 Kumamoto et al. ..... 439/470

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical interconnection device (100) includes a first connector (10), a second connector (20) defining a positioning member (25), a connecting member (30), a cover (50) enclosing the first connector and the second connector to combine therebetween and a restricting member (40) assembled to the first connector. The connecting member (30) electrically connects the first connector with the second connector. The restricting member (40) comprises a plate (41) mounted to the first connector and an elastic portion (44) connected to the plate, said elastic portion has at least two elastic arms spaced from one another, the elastic arms being selectively locked into positioning grooves (253) of the positioning member, while said first connector and second connector are swiveled.

11 Claims, 11 Drawing Sheets

ROTATABLE ELECTRICAL INTERCONNECTION DEVICE

BACKGROUND OF THE INVENTION

1. Field of the Invention

This application claims priority to prior Chinese patent applications 200820301476.9 and 200810303329.X, the disclosure of which are incorporated herein by reference.

The present invention generally relates to an electrical interconnection device, and more particularly to an electrical interconnection device which has two connector members interconnected together and capable of swiveling with respect to one another.

2. Description of Related Art

An electrical interconnection device is used for connecting two electronic devices. There are many different kinds of electrical interconnection devices, such as cable connector assembly and an electrical adapter. The cable connector assembly is mainly used for connecting two electronic devices relatively far away from each other; while the electrical adapter is utilized for connecting two electronic devices neighbored each other which usually have different I/O interfaces.

China Patent No. CN 2909618Y issued to Zhu on Jun. 6, 2007 discloses an electrical adapter for connecting two electronic devices having different interfaces to achieve signal and power transmission. The electrical adapter includes a USB plug connector, an audio plug connector and a cable between the USB plug connector and the audio plug connector. However the cable is too long, it will twist together possibly and be taken inconveniently.

U.S. Pat. No. 5,658,152 issued to Selker on Aug. 19, 1997 introduces a swivel plug. The plug is has male and female plug portions which pivot 180 degree, with respect to one another about a common pivot axis between first and second positions. A plurality of male and female electrical contact pairs slidably engage one another and pivot about the common pivot axis. Male and female bodies, which receive the electrical contact pairs, also pivot with respect to one another about the common pivot axis. The male and female bodies and the male and female electrical contact pairs are arranged in a novel relationship to mutually retain one other for the pivotal movement. The swivel plug eliminates the need for an electrical cord between an adapter of a laptop computer and a wall receptacle which has a downwardly located ground receptacle or a wall receptacle which has an upwardly located ground receptacle. The swivel plug also enables plugging a computer adapter or a typical extension cord into a receptacle where there is a rigid space constraint. However, as there is no stop means equipped in the swivel plug, a relation between the male portion and the female portion is uncontrollable.

Hence, an improved electrical interconnection device is highly desired to overcome the aforementioned problems.

SUMMARY OF THE INVENTION

Accordingly, an object of the present invention is to provide an improved swiveled electrical interconnection device.

In order to achieve the object set forth, an electrical interconnection device in accordance with the present invention comprises includes a first connector, a second connector defining a positioning member, a connecting member, a cover enclosing the first connector and the second connector to combine therebetween and a restricting member assembled to the first connector. The connecting member electrically connects the first connector with the second connector. The restricting member comprises a plate mounted to the first connector and an elastic portion connected to the plate, said elastic portion has at least two elastic arms spaced from one another, the elastic arms being selectively locked into positioning grooves of the positioning member, while said first connector and second connector are swiveled.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
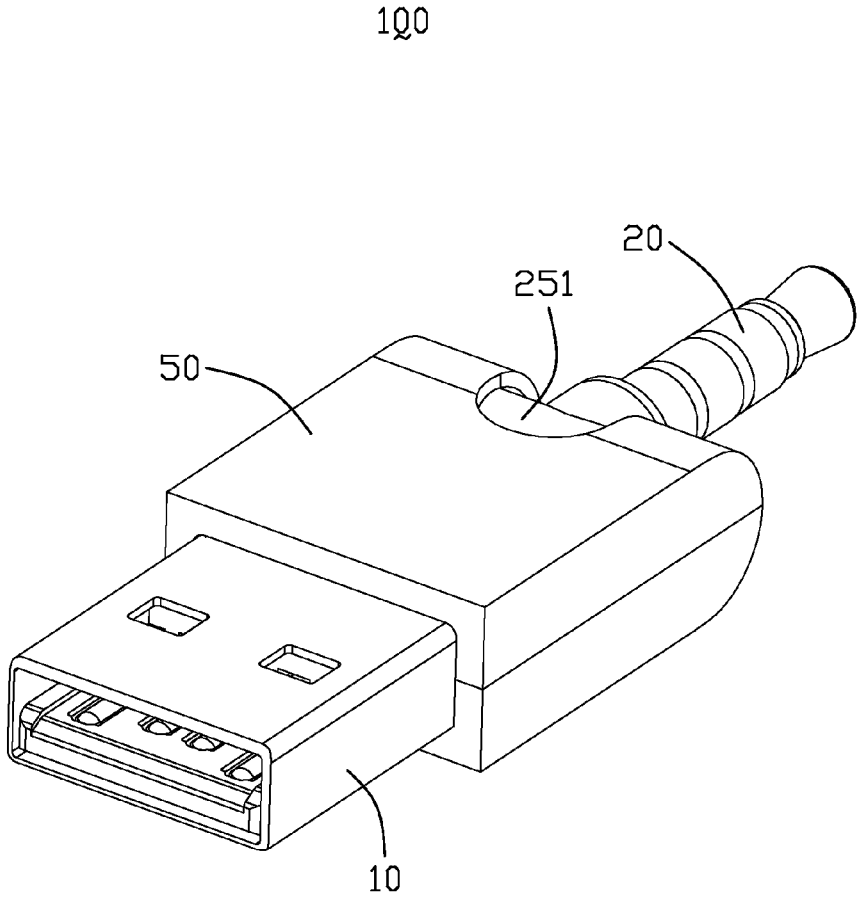
FIG. 1 is an assembled, perspective view of an electrical interconnection device in accordance with the present invention.
Figure 2:
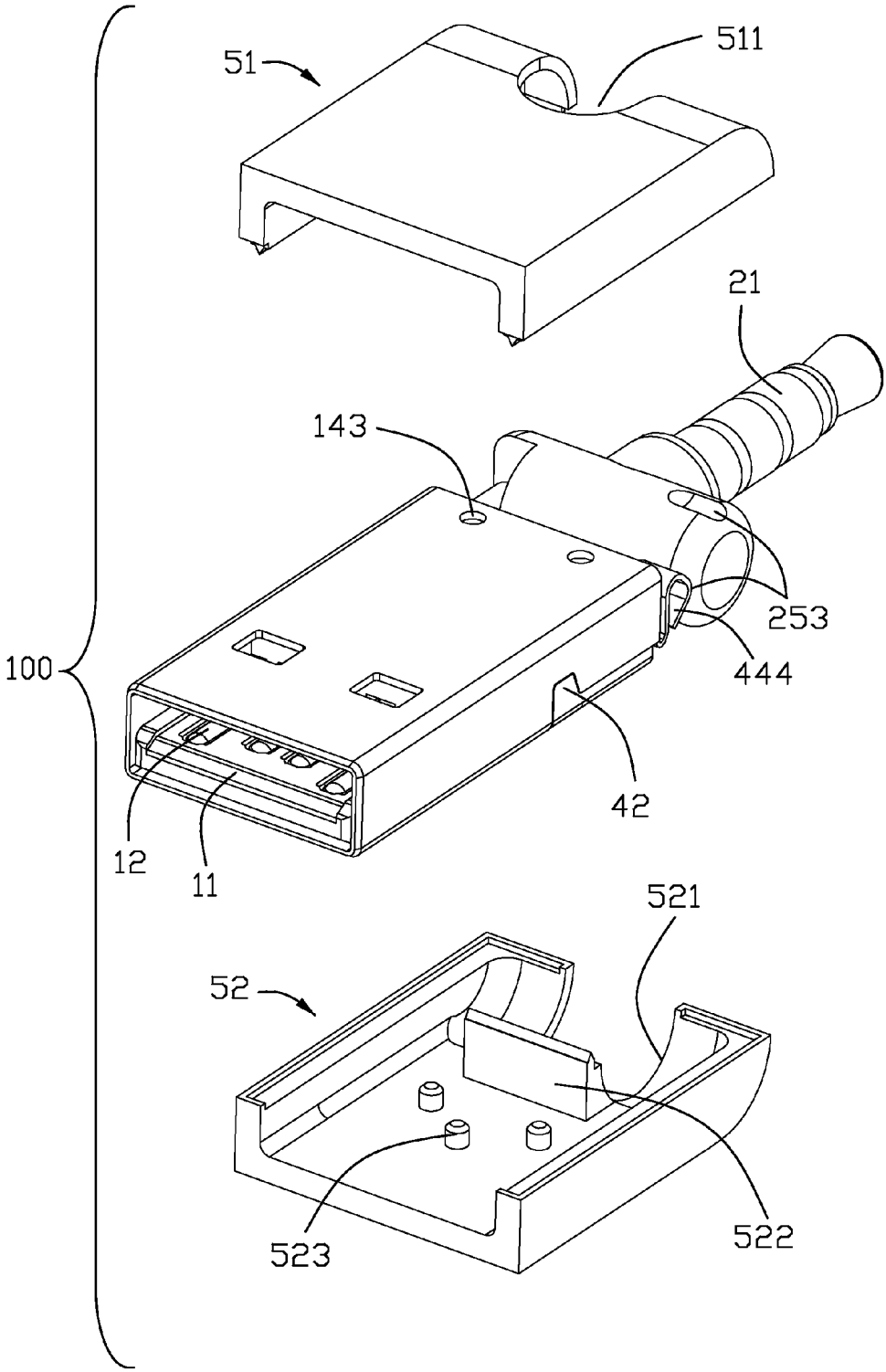
FIG. 2 is a partially assembled, perspective view of the electrical interconnection device.
Figure 3:
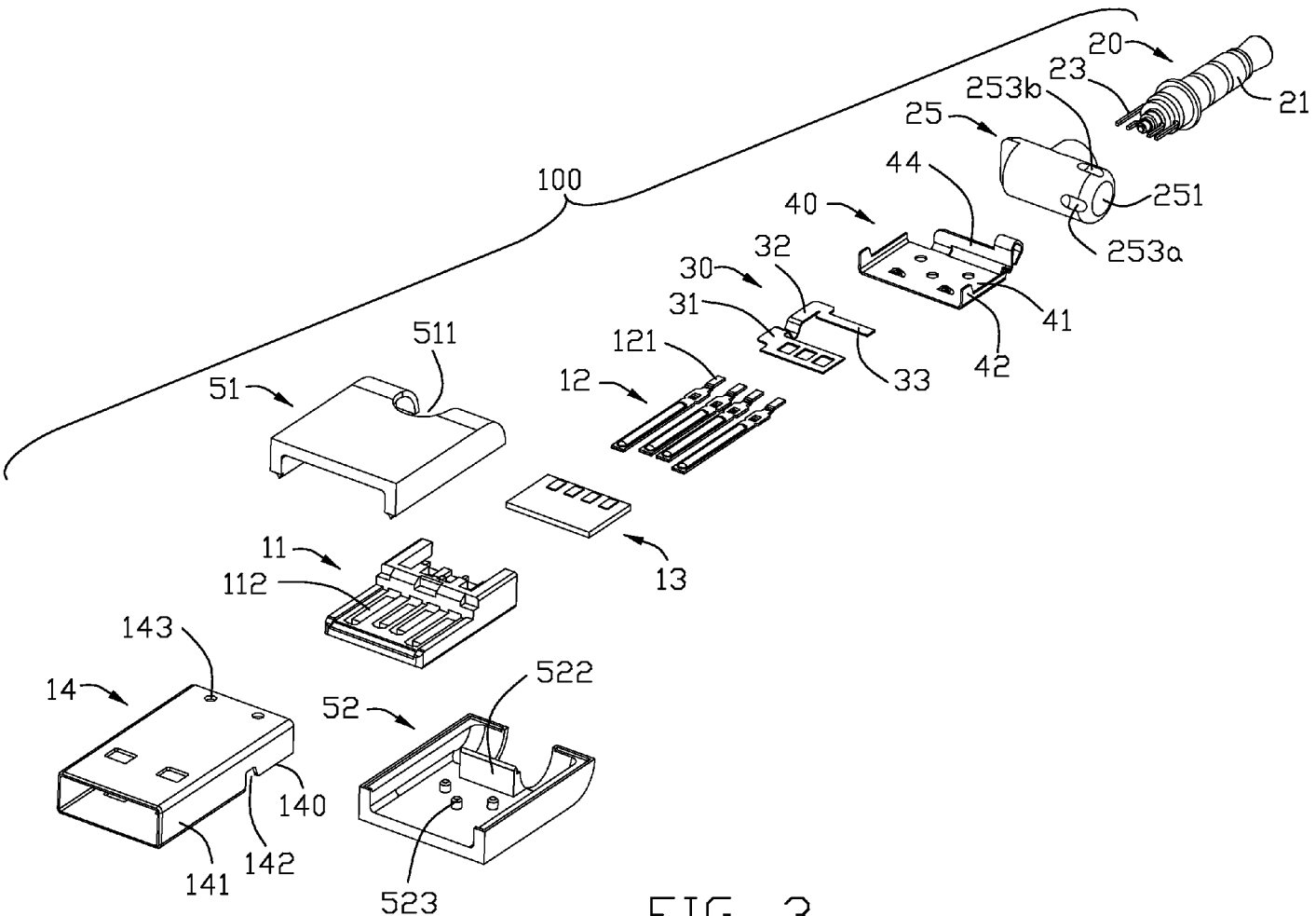
FIG. 3 is an exploded, perspective view of the electrical interconnection device.
Figure 4:
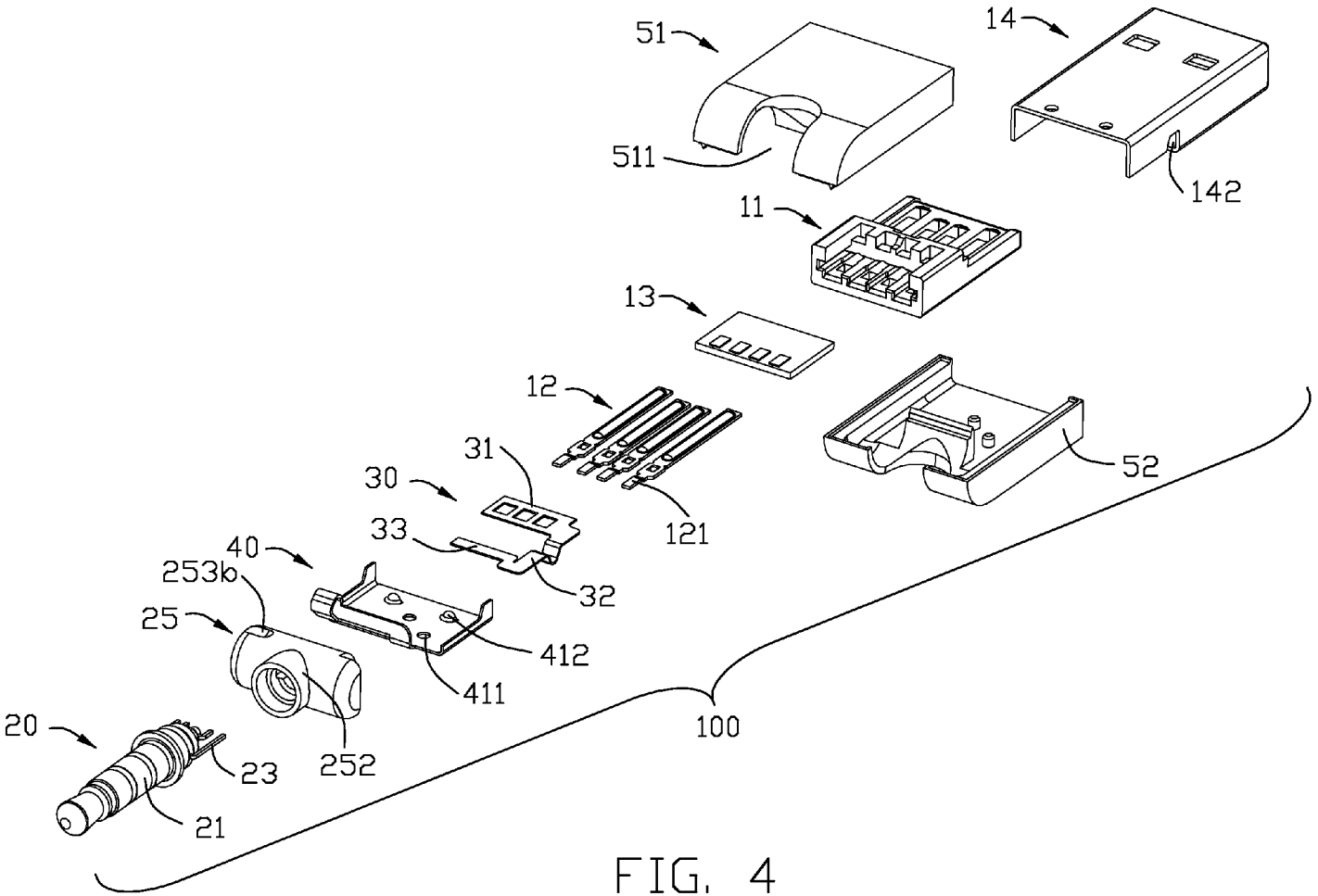
FIG. 4 is similar to FIG. 3, but viewed from another aspect.
Figure 5:
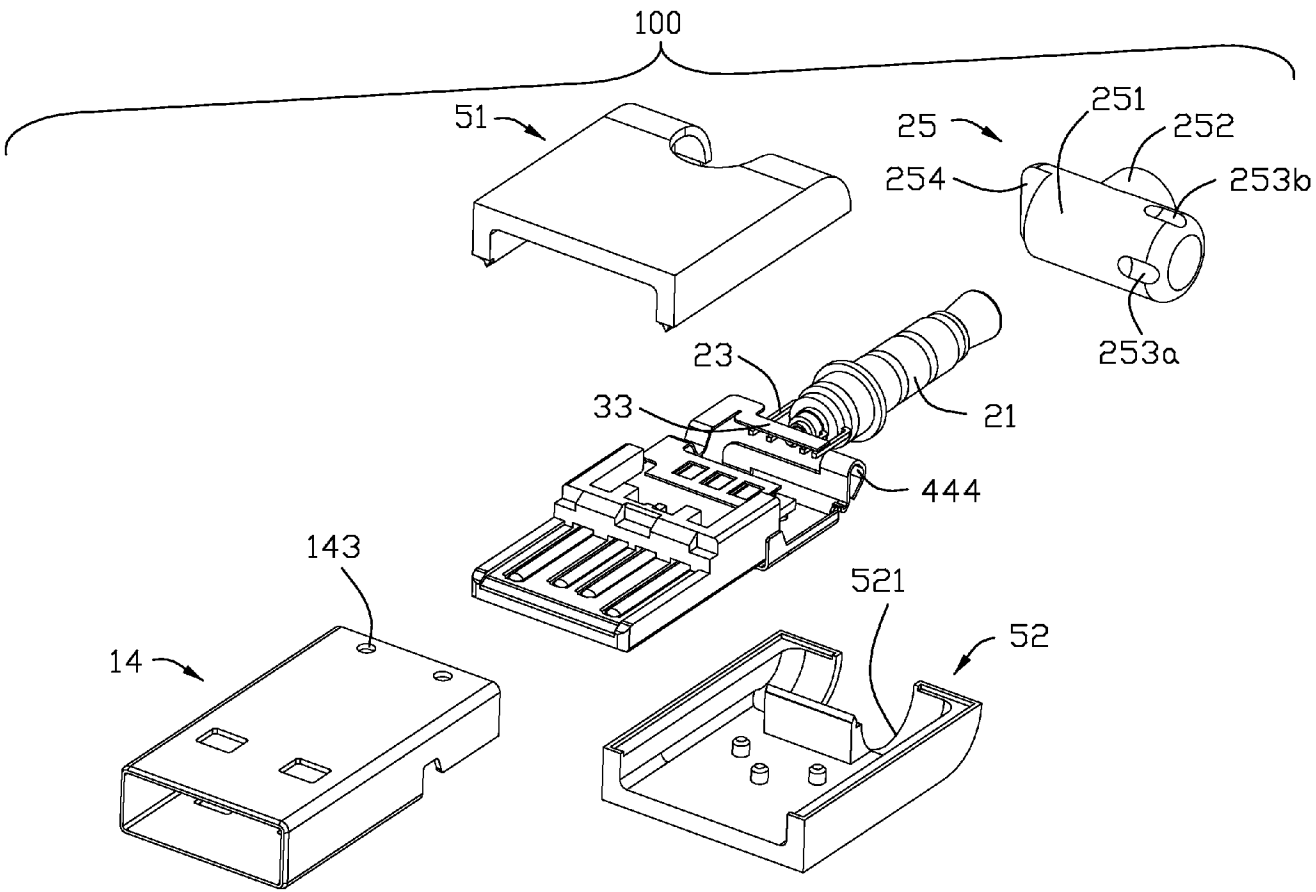
FIG. 5 is a partially assembled view of FIG. 3.
Figure 6:
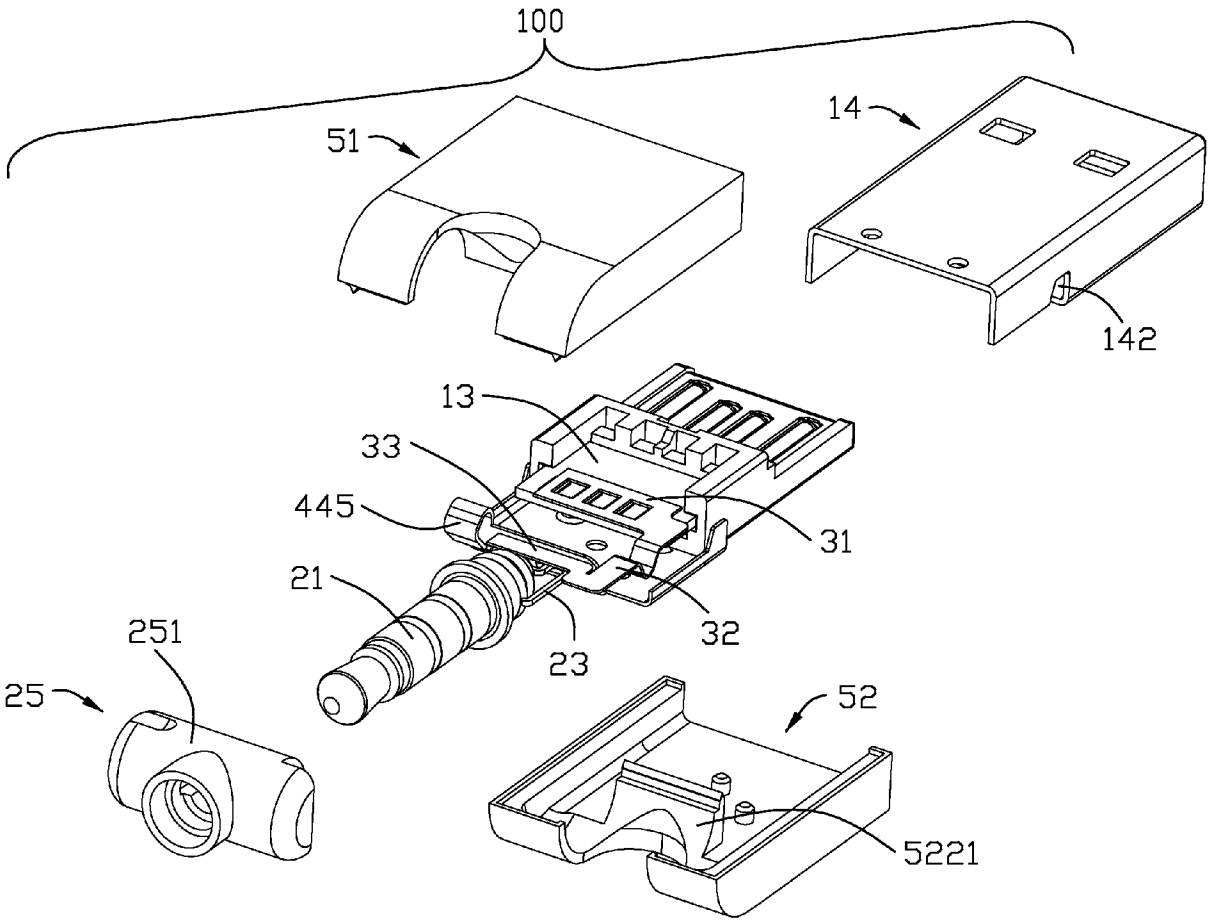
FIG. 6 is similar to FIG. 3, but viewed from another aspect.
Figure 7:
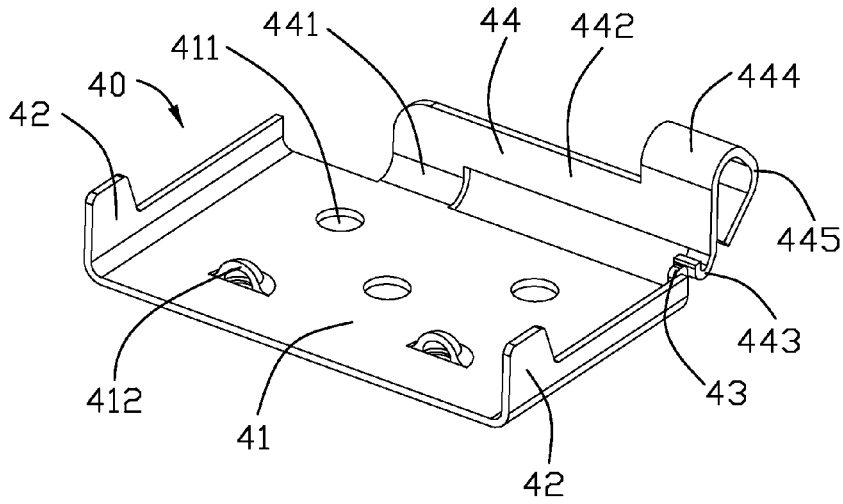
FIG. 7 is a restricting member of the electrical interconnection device.
Figure 8:
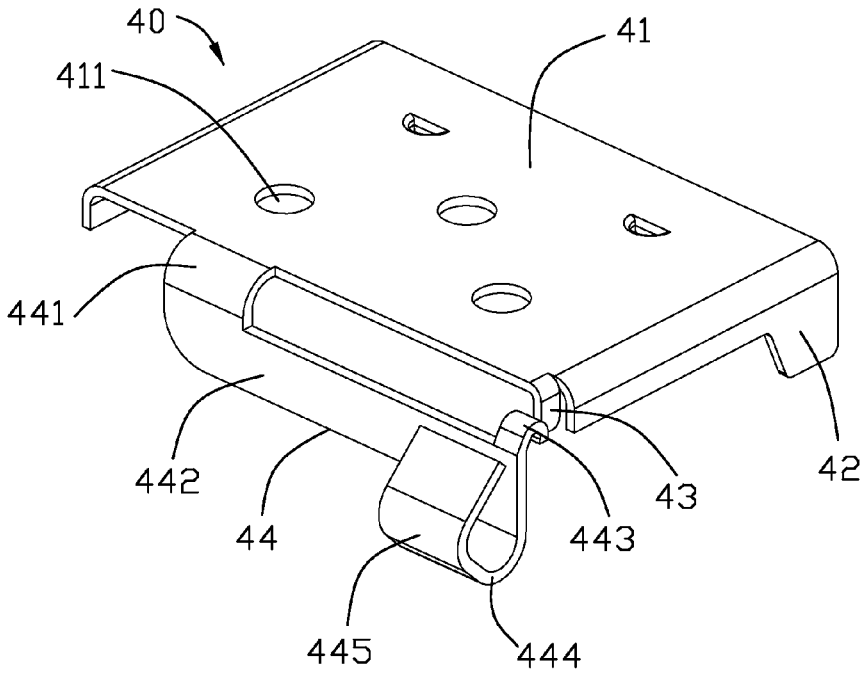
FIG. 8 is similar to FIG. 7, but viewed from another aspect.

Referring to FIGS. 1-3, an electrical interconnection device 100 in accordance with the present invention comprises a first connector 10, a second connector 20, a connecting member 30 electrically linking the first connector 10 and the second connector 20, a restricting member 40 and a cover 50 partially enclosing the first and second connectors 10, 20.

Referring to FIGS. 3-6, the first connector 10 is compatible with Universal Serial Bus (USB) transmitting protocol, however, it can be other types connector. The first connector 10 includes an insulated housing 11, a number of first contacts 12 mounted in corresponding receiving channels 112 of the insulated housing 11, a circuit board 13 electrically connected with the first contacts 12, and a metallic shell 14 enclosing the insulated housing 11. The metallic shell 14 defines an opening 140 in a bottom portion, a pair of cutouts 142 are formed on both side walls 141 of the metallic shell 14, a pair of engaging holes 143 are defined above the opening 140 along a transverse direction and adjacent to front end of the metallic shell 14.

The second connector 20 is an Audio Plug connector, however, it can be other types connector. The second connector 20 comprises a plug 21 and a plurality of second contacts 23 extending rearwards from the plug 21. A positioning member 25 is enclosing the second contacts 23, the positioning member 25 is of T-shaped and comprises a cylindrical axis 251 and a cylindrical receiving portion 252. Part of the axis 251 is cut to form a protruding portion 254 on one side thereof. The axis 251 is enclosing the second contacts 23, a number of positioning grooves 253 are defined in a peripheral portion of the axis 251 and opposite to the protruding portion 24. The positioning grooves 253 are separated from one another around the axis 251 equably, one pair of the positioning grooves 253*b*, 253*c* are located along a direction perpendicular to a mating direction of the plug 21, and the rest one 253*a* is defined along the mating direction.

The connecting member 30 is a flexible print circuit and connected with one end of the circuit board 13, and comprises a soldering portion 31, a curved portion 32 extending from one side of the soldering portion 31 along the mating direction and a linking portion 33. The soldering portion 31 is soldered on one surface of the circuit board 13, and tail portions 121 of the first contacts 12 are soldered on the other surface of the circuit board 13. The linking portion 33 extends from front end of the curved portion 32 along the transverse direction and is parallel to the soldering portion 31.

Referring to FIGS. 2-9, the restricting member 40 is assembled to the metallic shell 14, and cooperated with the opening 140 of the metallic shell 14. The restricting member 40 includes a plate 41, a pair of projecting portions 42 extending upwards from lateral walls of the plate 41, a block 43 protruding upwards from front edge of the plate 41 on the right side, and an elastic portion 44 extending forwardly from front edge of the plate 41. A plurality of fixing holes 411 and tubers 412 are disposed on the plate 41, said fixing holes 411 are arranged in triangular relationship, the tubers 412 align along the transverse direction for limiting the movement of the insulated housing 11. The projecting portions 42 are locked in the cutouts 142 of the metallic shell 14.

The elastic portion 44 comprises a curved bridging portion 441 extending and bending from the front edge of the plate 41, a first elastic arm 442 extending from the bridging portion 441 along the transverse direction, a second elastic arm 443 and a third elastic arm 444 extending from the top end and the bottom end of the first elastic arm 442 respectively. The first elastic arm 442 and the plate 41 are on different planes. The second elastic arm 443 and the third elastic arm 444 are of arc-shaped, in other embodiment they can be of other similar shape with elasticity. The second elastic arm 443 is smaller than the third elastic arm 444 in dimension, the second elastic arm 443, the third elastic arm 444 and the right end of the first elastic arm 442 form an S-shaped configuration together. The third arm 444 defines a vault 445 in middle thereof, the vault 445 is locked in the positioning grooves 253. The end of the second elastic arm 443 is adjacent to the block 43 which as a pivot for pressing the second elastic arm 443 and turning the third elastic arm 444.

The cover 50 includes a top cover 51 and a bottom cover 52 holding the first connector 10 and the second connector 20, the top cover 51 and the second cover 52 have the same configuration as each other, and comprise U-shaped outlets 511, 521 respectively. The bottom cover 52 disposes a stopper 522 neighboring to the outlet 521, the stopper 522 defines a cambered stopping surface 5221, the bottom cover 52 defines a plurality of posts 523 corresponding to fixing holes 411 of the restricting member 40. The other configuration of the top cover 51 same as the bottom cover 52 is omitted.

When assemble, the first contacts 12 are mounted in the receiving channels 112 of the insulated housing 11, the insulated housing 11 is assembled to the metallic shell 14, tail portions of the first contacts 12 are soldered on the lower surface of the circuit board 13, the linking portion 33 is soldered with the second contacts 23 of the second connector 20. The positioning member 25 is over-molded the electrical conjunction, the soldering portion 31 of the connecting member 30 is soldered on the upper surface of the circuit board 13, to achieve the electrical connection between the first connector 10 and the second connector 20. The restricting member is assembled to the opening 140 of the metallic shell 14, with the projecting portions 42 locked in the corresponding cutouts 142, and the vault 445 of the third elastic arm 444 locked in one of the positioning grooves 253. Then the assembled components are disposed in the bottom cover 52, the posts 523 of the bottom cover 52 are inserted into the fixing holes 411, the axis 251 of the positioning member 25 is arranged in front of the stopping surface 5221 of the stopper 522, to prevent the axis 251 sliding backwards. The protruding portion 254 is located on one side of the stopper 522. The top cover 51 is assembled to the bottom cover 52 from the top down to enclose the conjunction between the first connector 10 and the second connector 20, the posts (not shown) of the top cover 51 are received in the engaging holes 143 of the metallic shell 14. The axis 251 is held by the stopper 522 and the front wall of the top and bottom cover 51, 52, part of the axis 251 is exposed in the outlets 511, 521, the receiving portion 252 is exposed beyond the outlets 511, 521, the axis 251 can turn around a center shaft thereof in the space formed by the stopper 522 and the front wall of the top and bottom cover 51, 52.

Figure 9:
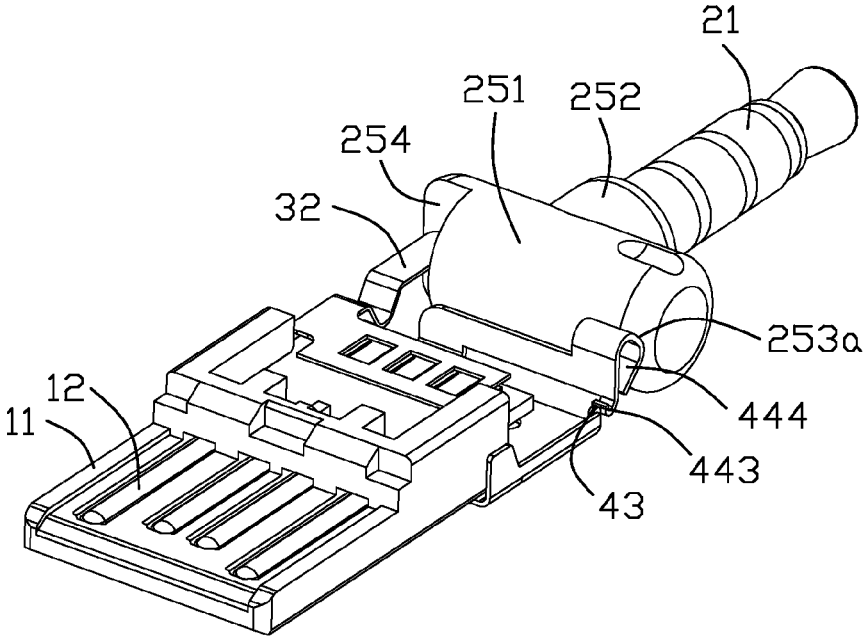
FIG. 9 is an assembled view of the electrical interconnection device with partial component removed.
Figure 10:
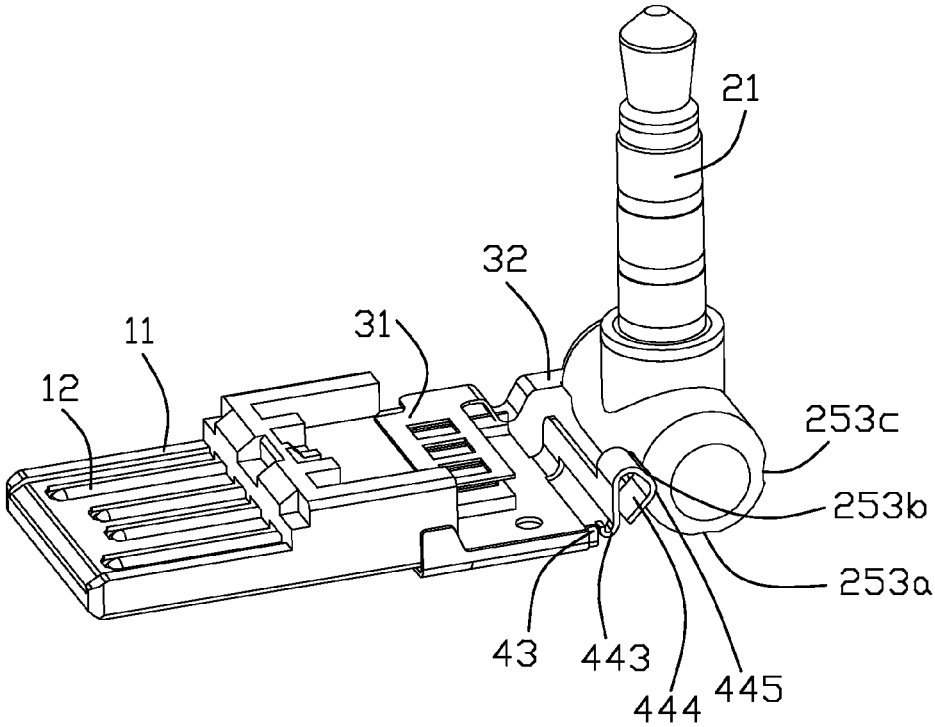
FIGS. 10-11 are another two stopping states in using of FIG. 9.
Figure 11:
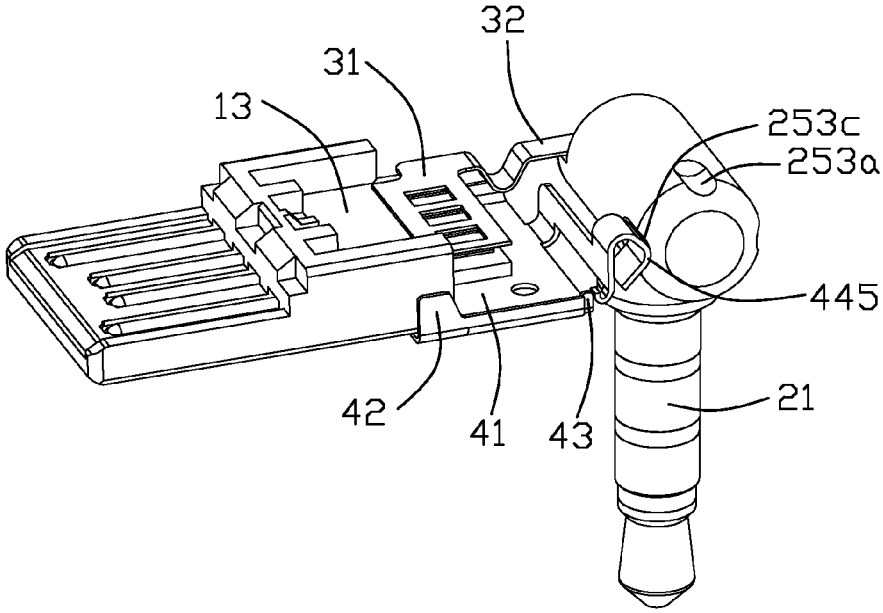

Referring to FIGS. 9-11, when the electrical interconnection device 100 located in the first state (see FIG. 9), the vault 445 of the elastic portion 44 is locked in the positioning groove 253*a* to form a first stopping point. The positioning member 25 rotates as the plug 21 of the second connector 20 swiveling, the axis 251 turns around center shaft thereof and slides out of the positioning groove 253*a*, as the block 43 is adjacent to the elastic portion 44, so the second elastic arm 443 and the third elastic arm 444 are compressed by an extra force, and the first elastic arm 442 are inclined rearwards. When rotating the plug 21 anticlockwise, the first, second and third elastic arm 442, 443, 444 are relaxed without extra force, and the vault 445 slides into the positioning groove 253*b* and is locked therein, while the external electronic device mating with the second connector 20, the external electronic device is located above the electrical interconnection device 100, with lower section of the external electronic device located above the cover 50 of the electrical interconnection device 100, the cover 50 could support the external electronic device. When rotating the plug 21 clockwise, the vault 445 can be locked in the positioning groove 253*c*, the movement process is similar to the anticlockwise rotating, so it's omitted.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection device, comprising:

a first connector;

a second connector defining a positioning member;

a connecting member electrically connected the first connector with the second connector;

a cover enclosing the first connector and the second connector to combine therebetween; and a restricting member comprising a plate mounted to the first connector and an elastic portion connected to the plate, said elastic portion having at least two elastic arms spaced from one another, the elastic arms being selectively locked into positioning grooves of the positioning member, while said first connector and second connector are swiveled, wherein the elastic arms include a first elastic arm not coplanar to the plate, a second and a third elastic arm extending from lateral sides of one end of the first elastic arm, the second elastic arm is neighboring to the plate and as a pivot for pressing the second elastic arm and turning the third elastic arm, the third elastic arm disposes a vault in middle thereof, said vault is adjacent to the positioning member to form a stopping point, wherein the restricting member also comprises projecting portions extending upwards from both sides of the plate and a block extending upwardly from lateral side neighboring to the elastic arms, wherein the second elastic arm, the third elastic arm and the right end of the first elastic arm form an S-shaped configuration together.

2. The electrical interconnection device as claimed in claim 1, wherein the restricting member further has a curved bridging portion connecting the plate and the first elastic arm.

3. The electrical interconnection device as claimed in claim 1, wherein the block is adjacent to the second elastic arm to prevent the elastic portion moving rearwards.

4. The electrical interconnection device as claimed in claim 1, wherein the second elastic arm is smaller than the third elastic arm in size.

5. The electrical interconnection device as claimed in claim 1, wherein the positioning member defines an axis, the positioning grooves are recessed in the axis, the vault can be selectively locked in one of the positioning grooves to form a stopping point.

6. The electrical interconnection device as claimed in claim 5, wherein the axis is perpendicular to a mating direction of the first connector, the positioning grooves are spaced from each other in a back peripheral portion of the axis equably.

7. The electrical interconnection device as claimed in claim 1, wherein the first connector defines a metallic shell with an opening, the restricting member is combined with the opening.

8. The electrical interconnection device as claimed in claim 1, wherein the connecting member is a flexible print circuit.

9. The electrical interconnection device as claimed in claim 1, wherein the first connector is compatible with Universal Serial Bus transmitting protocol, and comprises a plurality of first contacts connected with a circuit board with tail portions, the tail portions are soldered on one surface of the circuit board, with the connecting member soldered on the other surface of the circuit board.

10. The electrical interconnection device as claimed in claim 9, wherein second connector is an Audio Plug connector, and defines a number of second contacts electrically connected with a linking portion of the connecting member.

11. An electrical connector assembly comprising:

first and second connector units pivotally assembled together in a back-to-back manner, via a rigid printed circuit board and a deformable connecting member, with corresponding mating ports at opposite outermost ends respectively;

each of the first and second connector units including corresponding first contacts and second contacts, each of said first contacts including a first mating section and a first tail section, each of said second contacts including a second mating section and a second tail section, wherein the first mating section is exposed in the corresponding mating port of the first connector unit, and the first tail section is soldered upon the printed circuit board, the second mating section is exposed in the corresponding mating port of the second connector unit, and the second tail section is soldered upon the connecting member which is soldered upon the printed circuit board, wherein said connecting member defines a curved section experiencing deformation during relative rotative movement between the first connector unit and the second unit, wherein said connecting member further includes a cylindrical axis associated with the second connector unit, and a restriction member cooperates with the axis to retain the relative angle positions between the first connector unit and the second connector unit, and further including a case enclosing both the cylindrical axis and the restriction member and the connecting member and wherein the connecting member is a flexible printed circuit board and the restricting member comprising a plate mounted to the first connector unit and an elastic portion connected to the plate, said elastic portion having at least two elastic arms spaced from one another, the elastic arms being selectively locked into positioning grooves of the positioning member, while said first and second connector units are swiveled, wherein the elastic arms include a first elastic arm not coplanar to the plate, a second and a third elastic arm extending from lateral sides of one end of the first elastic arm, the second elastic arm is neighboring to the plate and as a pivot for pressing the second elastic arm and turning the third elastic arm, the third elastic arm disposes a vault in middle thereof, said vault is adjacent to the positioning member to form a stopping point.

* * * * *